US007425120B2

(12) United States Patent
Hembree

(10) Patent No.: US 7,425,120 B2
(45) Date of Patent: Sep. 16, 2008

(54) DIAPHRAGM POSITION CONTROL FOR HYDRAULICALLY DRIVEN PUMPS

(75) Inventor: Richard D. Hembree, Bellingham, WA (US)

(73) Assignee: Wanner Engineering, Inc., Minneapolis, MN (US)

( * ) Notice: Subject to any disclaimer, the term of this patent is extended or adjusted under 35 U.S.C. 154(b) by 395 days.

(21) Appl. No.: 11/114,706

(22) Filed: Apr. 26, 2005

(65) Prior Publication Data

US 2006/0239840 A1 Oct. 26, 2006

(51) Int. Cl.
*F04B 9/08* (2006.01)
*F04B 35/02* (2006.01)
*F04B 45/00* (2006.01)

(52) U.S. Cl. ..... 417/387; 417/388; 417/386; 417/395

(58) Field of Classification Search ..... 417/21, 417/24, 41, 46, 321, 375, 379, 383, 385, 417/386, 387, 388, 395, 490, 559, 568; 60/555, 60/592, 556, 561, 574, 600; 141/69; 137/53
See application file for complete search history.

(56) References Cited

U.S. PATENT DOCUMENTS

| | | | | |
|---|---|---|---|---|
| 2,919,650 | A * | 1/1960 | Wiggermann | 417/386 |
| 3,769,879 | A | 11/1973 | Lofquist | |
| 3,884,598 | A | 5/1975 | Wanner | |
| 4,050,859 | A | 9/1977 | Vork | |
| 4,416,599 | A * | 11/1983 | De Longchamp | 417/386 |
| 4,865,528 | A | 9/1989 | Fritsch et al. | |
| 4,883,412 | A | 11/1989 | Malizard et al. | |
| 5,246,351 | A | 9/1993 | Horn | |
| 5,667,368 | A | 9/1997 | Augustyn et al. | |
| 6,071,089 | A | 6/2000 | Maier et al. | |

* cited by examiner

*Primary Examiner*—Devon Kramer
*Assistant Examiner*—Peter J Bertheaud
(74) *Attorney, Agent, or Firm*—Merchant & Gould, P.C.

(57) ABSTRACT

A hydraulically driven pump includes a diaphragm, a piston, a transfer chamber, a fluid reservoir, and a spool member. The transfer chamber is defined between the diaphragm and piston and is filled with a hydraulic fluid. The fluid reservoir is in fluid communication with the transfer chamber via at least one valve. The spool member is configured to control fluid flow between the transfer chamber and the fluid reservoir. The spool member is movable to open and close an opening into the at least one valve only when an overfill condition or an underfill condition exists in the transfer chamber.

10 Claims, 6 Drawing Sheets

DIAPHRAGM POSITION CONTROL FOR HYDRAULICALLY DRIVEN PUMPS

BACKGROUND OF THE INVENTION

1. Field of the Invention

The present invention generally relates to fluid pumps and more specifically relates to hydraulically driven diaphragm pumps.

2. Related Art

Hydraulically driven diaphragm pumps can be dived into at least two groups. The first group includes pumps that use a different stroke for the hydraulic piston or plunger than that of the diaphragm. These pumps can be referred to as asynchronous pumps. Asynchronous pumps are commonly used for metering in large diaphragm pumps where it is desirable to have a large diameter diaphragm that only defects a small amount (a "short stroke"). Short stroke diaphragms are typically driven by a much longer stroke hydraulic plunger or piston. The long stroke of the piston makes possible the use of a small diameter for the piston, which result in smaller loads on the crankshaft and crankcase that must move the piston through its stroke.

The second group includes pumps where the diaphragm center moves the same distance as the hydraulic piston. These pumps can be referred to as synchronous pumps. The diaphragm position in synchronous pumps is controlled by a valve in the piston that maintains a constant distance between the piston and diaphragm center.

An example valving system for diaphragm position control in synchronous pumps is disclosed in U.S. Pat. No. 3,884,598 (Wanner), which is incorporated herein by reference. Wanner discloses a system that senses the position of the diaphragm relative to the piston, and then functions to keep the position of the diaphragm constant. The Wanner system is useful for pumps that must operate at a high speed or that pump abrasive materials because the system permits the use of elastomeric diaphragms that do not need to come into contact with a stop surface at the end of stroke. However, if the piston travels more than the travel distance of the diaphragm, this system will not be able to properly maintain the amount of hydraulic fluid behind the diaphragm for the pump to function properly.

Some example asynchronous pumps are described in U.S. Pat. No. 5,246,351 (Horn), U.S. Pat. No. 5,667,368 (Augustyn), and U.S. Pat. No. 4,883,412 (Malizard). These example pumps all use a similar approach to diaphragm position control. Each of these pumps momentarily adjusts the amount of oil at the top or bottom of every stroke stroke. An overfill condition is detected when the diaphragm travels to far forward and reaches a limit of travel. This causes a higher than normal pressure of the hydraulic fluid, which causes a valve to momentarily open and release some of the excess fluid. This excess pressure is generated when the diaphragm reaches a stop, or simply the end point of deflection where higher pressure is required to move the diaphragm further. This pressure is not transmitted to the pumped fluid and therefore produces an unbalanced pressure drop across the diaphragm. This method of dealing with pressures created by overfill requires that the diaphragm includes materials and a configuration adequate to handle this unbalanced pressure without the diaphragm failing. This limitation on diaphragm materials and design results in the use of very large diameter, low deflection diaphragms that greatly increase the size and cost of the pump.

Known asynchronous hydraulically driven pumps do not allow for the use of highly flexible elastomeric diaphragms that are relatively small and capable of undergoing large deflections for at least those reasons discussed above. As a result, the use of these types of diaphragms is limited to synchronous pumps. The piston stroke in a synchronous pump must be relatively short since it is limited to the diaphragm stroke. This makes the crankshaft and crankcase bear the higher loads of a larger diameter piston, making the drive side of the pump more expensive.

Another example hydraulically driven pump is disclosed in U.S. Pat. No. 3,769,879 (Lofquist). Lofquist discloses a spool that moves with every stroke of the diaphragm to momentarily open ports between a fluid reservoir and the hydraulic chamber (e.g., transfer chamber) behind the diaphragm at the ends of the piston stoke. The ports and moving spool allow only a small pulse of fluid to pass with each stroke in order to correct an overfill or underfill condition.

Lofquist has some significant disadvantages under conditions of extreme underfill or overfill (e.g., conditions caused by very low or very high pump inlet pressure for the pumped fluid). Under extreme overfill conditions, the small pulse of fluid permitted with each stroke is insufficient to immediately correct the overfill, which results in stressing of the diaphragm until enough strokes occurred to correct the overfill condition. Another shortcoming of Lofquist relates to the direction in which the diaphragm is biased. Under extreme conditions (e.g., low inlet and outlet pressure for the pumped fluid caused by, for example, a blocked inlet to the pump), the Lofquist system tends to add oil to the transfer chamber without any bias applied to the diaphragm that would otherwise discharge the overfill of oil. As a result, the overfill cannot be solved and the diaphragm will fail.

There is a need therefore for a diaphragm position control that permits use of a highly flexible elastomeric diaphragms that are relatively small and capable of undergoing large deflections in both synchronous and asynchronous hydraulic pumps.

SUMMARY OF THE INVENTION

One aspect of the invention relates to a diaphragm pump that includes a piston, a diaphragm, pumping and transfer chambers, first and second valves, a fluid reservoir, and a valve spool. The piston is adapted for reciprocal movement between a first position and a second position. The diaphragm is movable between first and second positions that correlate with the first and second piston positions. The transfer chamber is positioned on one side of the diaphragm and is defined in part by the relative positions of the diaphragm and the piston. The transfer chamber is filled with a hydraulic fluid. The pumping chamber is positioned on an opposing side of the diaphragm from the transfer chamber. The fluid reservoir is in fluid communication with the transfer chamber via the first and second valves. The valve spool is positioned in the transfer chamber and arranged to cover openings of the first and second valves when the valve spool is in a first position, to cover the opening of the first valve and open the opening of the second valve when the valve spool is in a second position, and to open the opening of the first valve and close the opening of the second valve when the valve spool is in a third position. The spool maintains the first position until an overfill condition is generated in the transfer chamber that moves the spool to the second position, or until an underfill condition is generated in the transfer chamber that moves the spool to the third position.

Another aspect of the invention relates to a hydraulically driven pump that includes a diaphragm, a piston, a transfer chamber, a fluid reservoir, and a spool member. The transfer chamber is defined between the diaphragm and piston and is filled with a hydraulic fluid. The fluid reservoir is in fluid communication with the transfer chamber via at least one valve. The spool member is configured to control fluid flow between the transfer chamber and the fluid reservoir. The spool member is movable to open and close an opening into the at least one valve only when an overfill condition or an underfill condition exists in the transfer chamber.

A further aspect of the invention relates to a method of balancing fluid pressure in a hydraulically driven diaphragm pump. The pump includes a diaphragm, a piston, a transfer chamber interposed between the diaphragm and the piston, a fluid reservoir, a spool member, and at least one valve providing fluid communication between the fluid reservoir and the transfer chamber. The method includes moving the piston to alter a position of the diaphragm and controlling with the spool member fluid flow between the fluid reservoir and the transfer chamber through the at least one valve with the spool member. The spool member maintains a first position restricting fluid flow through the at least one valve until an fluid overfill condition or an fluid underfill condition in the transfer chamber is generated that causes the spool member to move thereby permitting fluid flow through the at least one valve.

DETAILED DESCRIPTION OF THE PREFERRED EMBODIMENT

Figure 1:
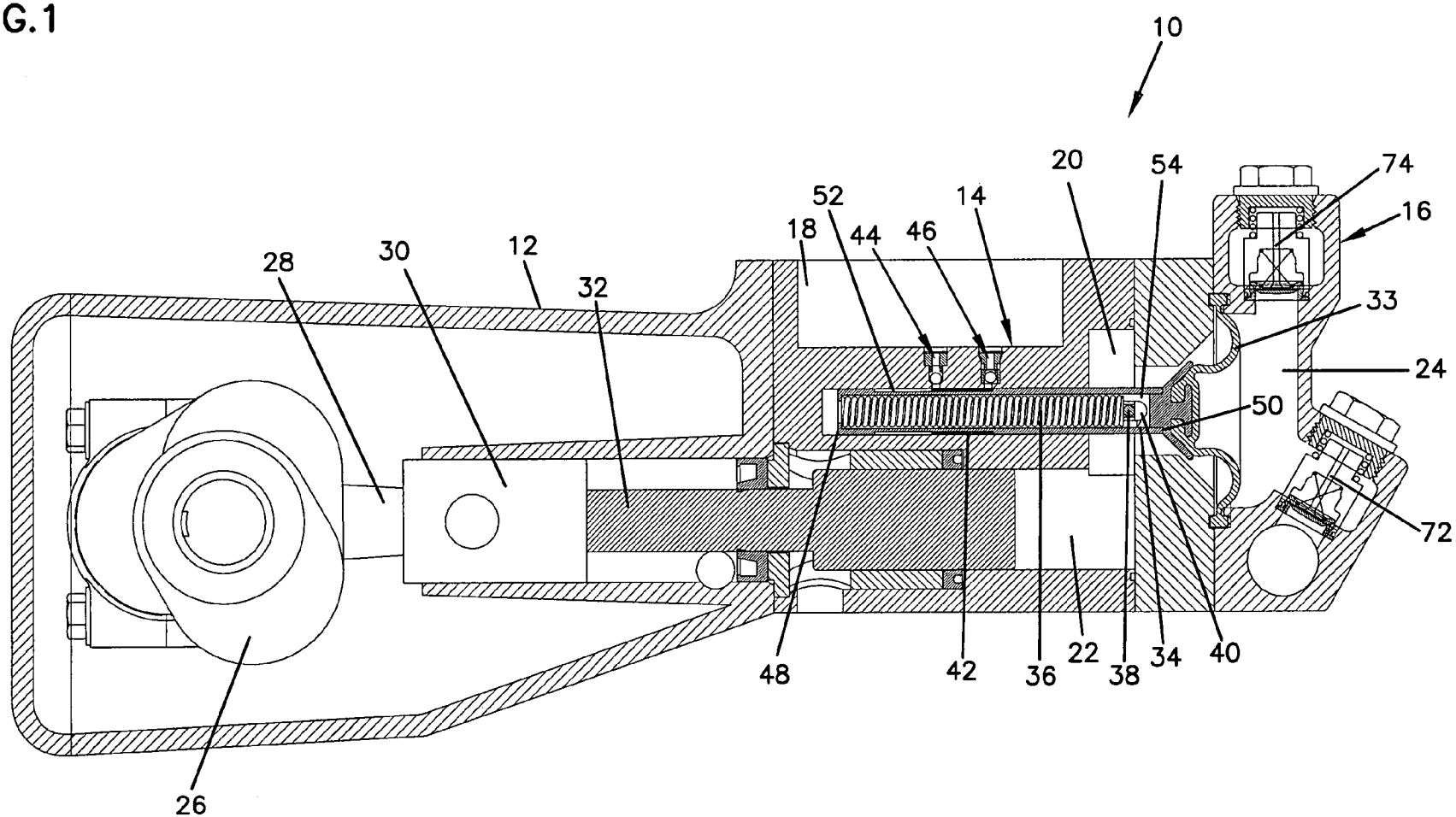
FIG. 1 is a cross-sectional side view of an example pump according to principles of the present invention with the diaphragm in a fully extended position.

The present invention generally relates to fluid pumps such as hydraulically driven diaphragm pumps. Principles of the present invention are equally applicable to asynchronous and synchronous pumps. In asynchronous pumps there is a different stroke for the hydraulic piston versus a stroke of the diaphragm. The diaphragm is typically relatively large in diameter and is configured to deflect a relatively small amount. This short stroke diaphragm is driven by a much larger stroke hydraulic plunger or piston. The longer the stroke of the hydraulic plunger or piston, the smaller the diameter of the piston is required, which imparts smaller loads on the crankshaft and crankcase of the pump.

Synchronous pumps are configured such that the center of the diaphragm moves the same distance as the hydraulic piston moves. In such pumps, the diaphragm must deflect large distances corresponding to the piston stroke in order to minimize loads on the crankcase and crankshaft resulting from use of a relatively small diameter piston. If it is not possible for the diaphragm to deflect to the extent necessary to ensure a relatively small diameter piston, the piston diameter must be enlarged, thus creating greater loads on the crankshaft and crankcase. The present invention can be used with either of asynchronous or synchronous pumps to help control a position of the diaphragm to ensure that the diaphragm does not extend or retract beyond predetermined distances that may otherwise lead to failure of the diaphragm.

Many known diaphragm position control systems function based on hydraulic pressure conditions within the transfer chamber on a side of the diaphragm opposite of the fluid being pumped. Such pressure-based systems typically utilize relief valves that open or close in response to certain pressure levels. The relief valves are typically positioned between the hydraulic chamber and a reservoir of hydraulic fluid. In systems designed for relieving overpressure, the relief valve momentarily opens to release some of the hydraulic fluid to the reservoir when a maximum pressure is surpassed. In systems designed for relieving under pressure, a separate relief valve momentarily opens to draw some hydraulic fluid from the reservoir into the hydraulic chamber when the pressure drops below a minimum pressure.

Overpressure is typically generated in such systems at the point where the diaphragm reaches a stop such as at the end of deflection where high pressure is required to deflect the diaphragm further. In order to account for the overpressure conditions, the diaphragm must be made of a relatively strong, inflexible material that can resist failure after repeated cycles of high and low pressure. Increasing the diameter and decreasing the amount of deflection the diaphragm must make can also account for the high pressure conditions, but can also greatly increase the size and cost of the pump.

Another issue related to pressure-based systems is cavitation. The excess pressure in the transfer chamber is typically not transmitted to the pumped fluid and therefore creates an unbalanced pressure condition (i.e., pressure drop) across the diaphragm. This pressure drop can lead to vacuum conditions during certain portions of the piston stroke that may lead to cavitation in the hydraulic fluid. Cavitation can lead to increased wear (e.g., pitting) of the components exposed to the hydraulic fluid.

The present invention functions based on volume rather than pressure within the hydraulic chamber. Depending on the under or overfill volume condition within the hydraulic chamber, a movable valve spool shifts in the hydraulic chamber between positions covering or uncovering openings to check valves that are positioned between a hydraulic reservoir and the hydraulic chamber. It is the fluid itself rather than a pressure condition generated by the fluid that moves the valve spool. The underfill or overfill volume condition is typically best assessed at either the top or bottom of the piston stroke. The present invention is configured such that the valve spool moves only at the top or bottom of the piston stroke to correct either the underfill or the overfill condition.

Figure 2:
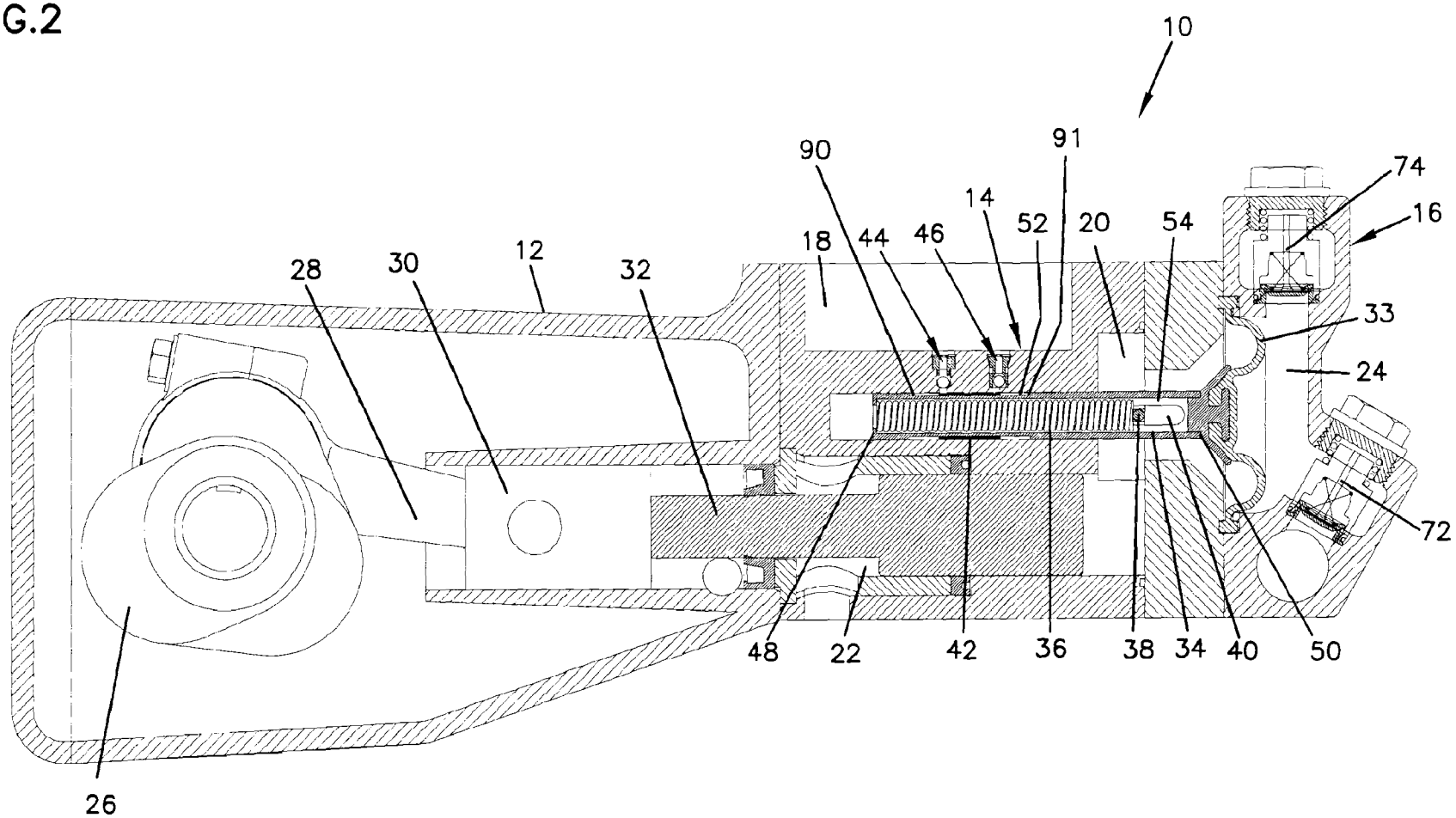
FIG. 2 is a cross-sectional side view of the example pump shown in FIG. 1 with the diaphragm in a fully retracted position.
Figure 3:
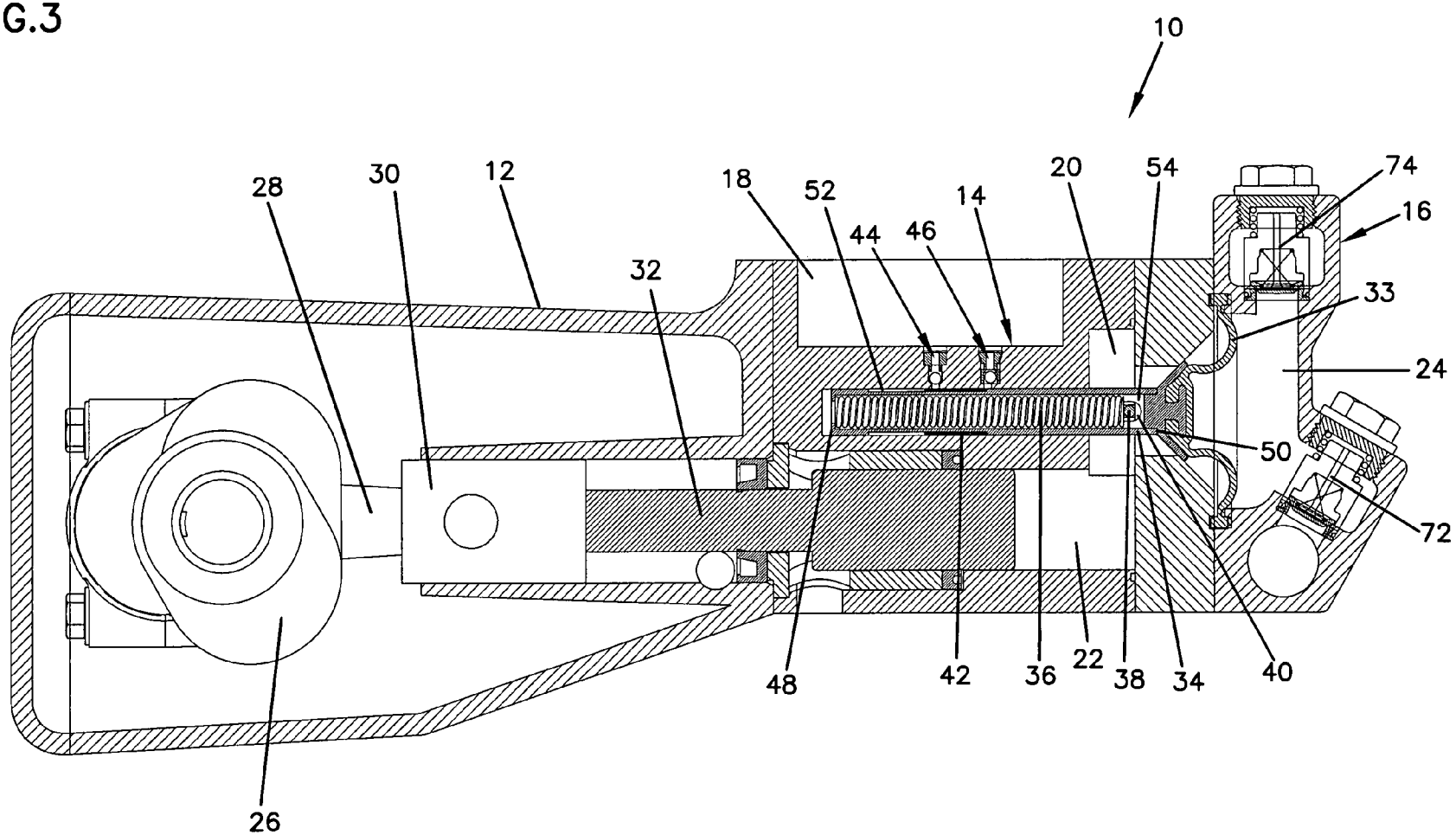
FIG. 3 is a cross-sectional side view of the example pump shown in FIG. 1 with the diaphragm in a fully extended position subject to an underfill condition.
Figure 4:
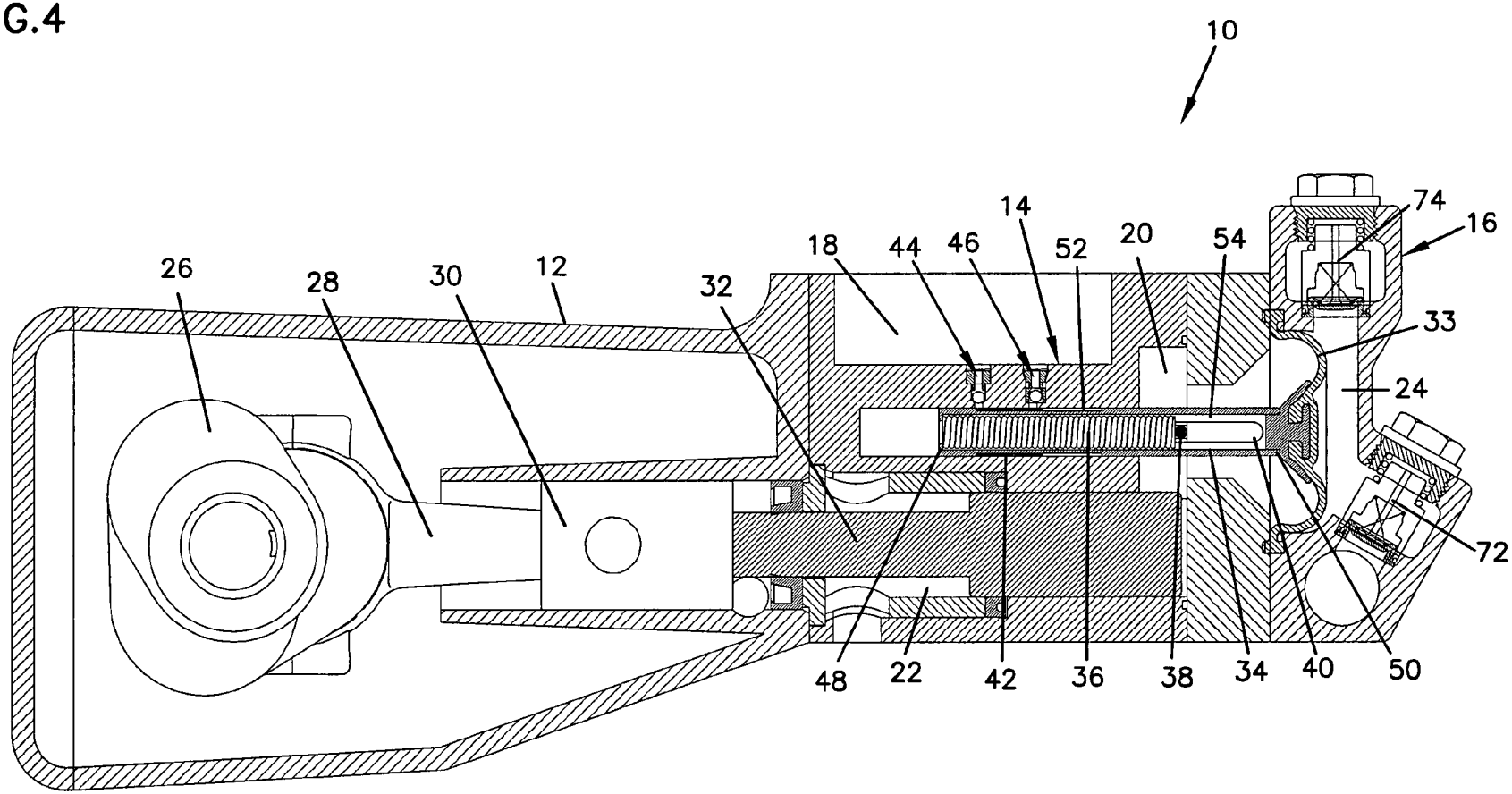
FIG. 4 is a cross-sectional side view of the example pump shown in FIG. 2 with the diaphragm in a fully retracted position subject to an overfill condition.

An example asynchronous diaphragm pump 10 that illustrates principles of the present invention is shown and described with reference to FIGS. 1-6. FIG. 1 illustrates the pump piston at bottom dead center (BDC) with a normal fill condition. FIG. 2 illustrates the piston at a mid stroke with a normal fill condition. FIG. 3 illustrates the piston at BDC with an underfill condition. FIG. 4 illustrates the piston at a top dead center (TDC) with an overfill condition.

Pump 10 includes a crankcase 12, a piston housing 14, and a manifold 16. The piston housing 14 defines a reservoir 18, a transfer or hydraulic chamber 20, and a plunger chamber 22. The manifold 16 defines a pumping chamber 24 and includes inlet and outlet valves 72, 74.

A crankshaft 26, connecting rod 28, and slider 30 are positioned within the crankcase 12. The slider 30 is coupled to a plunger 32 positioned within the plunger chamber 22. The transfer and plunger chambers 20, 22 are in fluid communication with each other such that fluid drawn into or forced out of the plunger chamber 22 draws the diaphragm into a retracted position or forces the diaphragm into an extended position as shown in FIGS. 1 and 2, respectively.

A valve stem 34 is extends through the transfer chamber 20. The valve stem includes first and second ends 48, 50, a spool recess 52, and a hollow core 54. A spring 36 is positioned within the core 54 between the first end 48 and a spring retaining pin 38 that extends into the valve stem 34. The valve stem 34 includes a pin slot 40 sized to permit the valve stem 34 to move relative to the pin 38 as the diaphragm 33 moves through its stroke between extended and retracted positions. The second end 50 of the valve stem is coupled to the diaphragm 33.

A valve spool 42 is positioned within the spool recess 52 along an outer circumference of the valve stem 34. The spool recess 52 is sized such that the valve spool 42 can move between a first position (shown in FIGS. 1 and 2) covering openings 56, 64 into respective overfill and underfill valves 44, 46 that are positioned between the reservoir 18 and the transfer chamber 20. The valve spool 42 can also move to a second position shown in FIG. 3 in which the valve spool 42 continues to cover the opening 56 to the overfill valve 44 but is moved away from the opening 64 to the underfill valve 46 so as to provide fluid flow between the reservoir 18 and the transfer chamber 20. The spool 42 is also movable to a third position as shown in FIG. 4 in which the spool covers the opening 64 to the underfill valve 46 but is moved away from the opening 56 to the overfill valve 44 to provide fluid communication between the transfer chamber 20 and the reservoir 18. The spool recess 52 defines first and second shoulders 90, 91 at opposing ends of the spool recess 52 that function as stop members against which opposing ends of the valve spool 42 are engaged to axially move the valve spool relative to the openings 56, 64 in underfill and overfill conditions.

Figure 6:
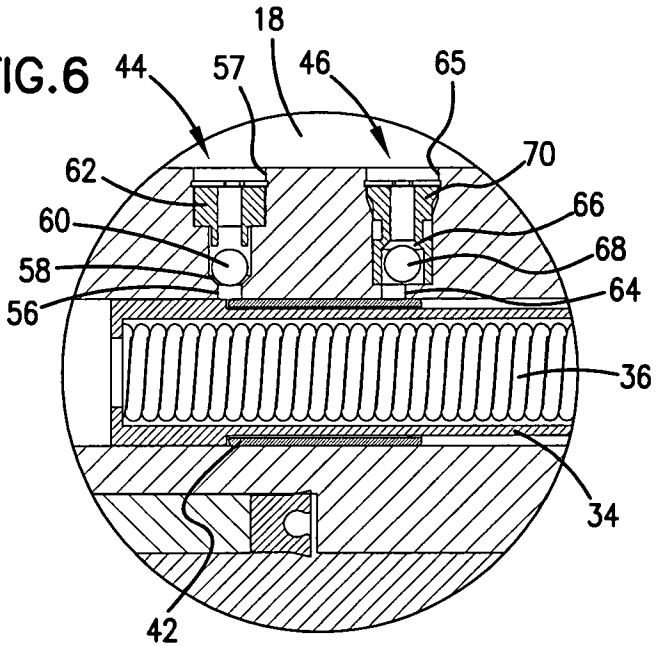
FIG. 6 is a close-up view of the overfill and underfill valves shown in FIG. 4.
Figure 5:
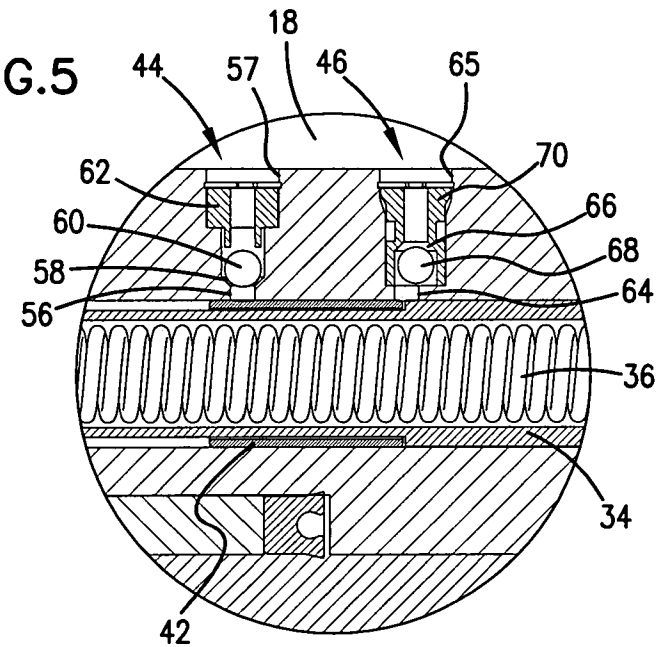
FIG. 5 is a close-up view of the overfill and underfill valves shown in FIG. 3.

FIGS. 5 and 6 provide close-up views of the underfill and overfill conditions shown in FIGS. 3 and 4. The overfill valve 44 includes an opening or passage 56 adjacent to the valve spool 42 and another opening 57 adjacent to the hydraulic chamber 18. A seat 58 sized smaller than the diameter of the ball 60 is positioned so that the ball cannot pass through the opening 56. A plug 62 retains the ball 60 between the openings 56, 57 and includes an aperture that permits fluid to flow from the transfer chamber 20, through the openings 56, 57, and into the hydraulic chamber 18.

The underfill valve 46 includes an opening or passage 64 adjacent to the valve spool 42, another opening 65 adjacent to the hydraulic chamber 18, a ball 68, and a plug 70 that defines a seat 66. The ball 68 is retained between the openings 64, 65 by the plug 70. The plug 70 includes an aperture that permits fluid to flow from the hydraulic chamber 18, through the openings 64, 65, and into the transfer chamber 20.

The overfill and underfill valves 44, 46 are check valves that permit one-way fluid flow. Thus, when the spool valve 42 moves to expose opening 56, fluid from the transfer chamber moves the ball 60 away from the seat 58 to permit fluid to transfer from the transfer chamber 20 to the reservoir 18. Likewise, when the spool valve 42 moves to expose opening 64, the ball 68 moves away from seat 66 to permit fluid to flow from the reservoir 18 to the transfer chamber 20.

In the embodiment of FIGS. 1-6, the valve spool 42 provides the important function of covering the openings 56, 64 to prevent fluid flow between the chamber 20 and reservoir 18. The valve spool 42 also, when moved into a position expose one or the other of the openings 56, 64, permits fluid flow in a desired direction between the reservoir 18 and transfer chamber 20 to relieve overfill or underfill conditions that exist in the transfer chamber 20.

Figure 7:
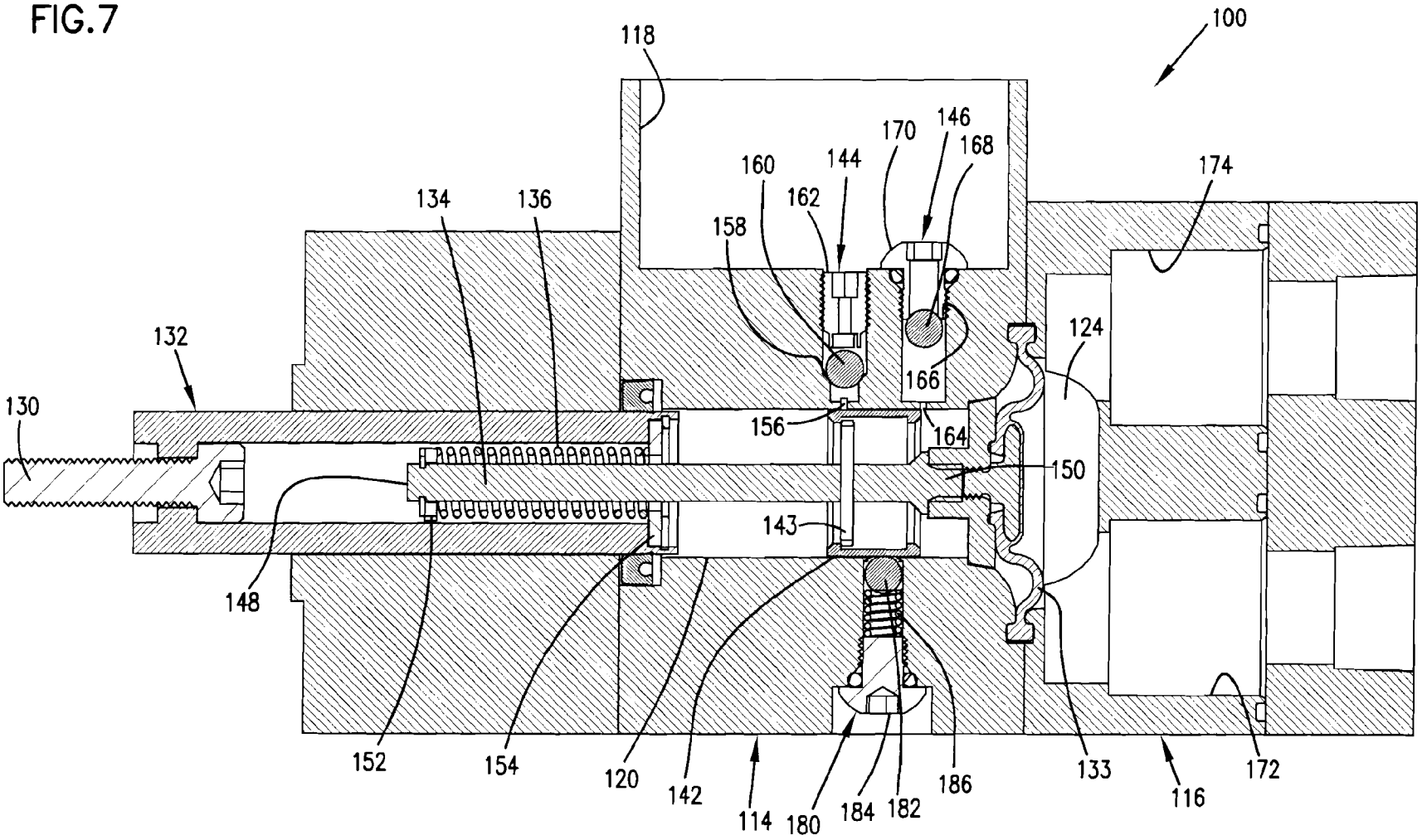
FIG. 7 is a cross-sectional side view of another example pump according to principles of the present invention with the diaphragm in a fully retracted position subject to an underfill condition.

Referring now to FIG. 7, another example pump 100 that incorporates principles of the present invention is shown and described. Pump 100 includes a piston housing 114 and a manifold 116. The crankcase of pump 100 is not shown in FIG. 7, but could be structured similar to crankcase 12 and include a crankshaft and other features similar to pump 10.

The piston housing 114 includes a reservoir 118 and a transfer chamber 120. The manifold 116 defines a pumping chamber 124 and includes an inlet 172 and an outlet 174. A plunger 132 is positioned within a plunger sleeve 130. The plunger 132 may be coupled to a crankshaft via a connecting rod and other features not shown in the figures.

The plunger 132 is coupled to a diaphragm 133 via a valve stem 134. The valve stem 134 includes first and second ends 148, 150, wherein the first end 148 includes a spring stop member 152 that retains a spring 136 against a cap 154 coupled to an opposing end of the of the plunger sleeve 130. A valve spool 142 is positioned within the transfer chamber 120 in substantial alignment with overfill and underfill valves 144, 146. The valves 144, 146 are positioned between the reservoir 118 and the transfer chamber 120. The valve spool 142 maintains a generally stationary orientation relative to openings 156, 164 into respective overfill and underfill valves 144, 146 until engaged by a spool pin 143 (also referred to as a stop member 143) that is mounted to the valve stem 134. The valve spool 142 is constructed so that the spool pin 143 engages an inner surface of the valve spool when an underfill or an overfill condition exists in the transfer chamber 120. Typically, the spool pin 143 only engages the valve spool 142 when the plunger 132 is at a top dead center or a bottom dead center position where the diaphragm 133 is fully retracted or extended.

The overfill valve 144 includes openings 156, 157, a seat 158, a ball 160, and a plug 162. The underfill valve 146 includes openings 164, 165, a seat 166, a ball 168, and a plug 170. The valves 144, 146 are configured as check valves that provide flow between the transfer chamber 120 and hydraulic chamber 118 so long as both openings 156, 157 and 164, 165 are free from obstruction.

In some embodiments, the plugs 162, 170 of respective overfill and underfill valves 144, 146 may also be adjustable to alter, for example, the extent to which the respective balls 160, 168 can move within the openings 156, 164. A position of the balls 160, 168 may influence a rate of fluid flow through the valves 144, 146.

FIG. 7 illustrates the valve spool 142 moved into a position covering the overfill valve opening 156 while being removed from covering the underfill valve opening 164. The moved position of valve spool 142 from a neutral position covering both openings 156, 164 occurs due to an underfill condition in the transfer chamber 120. With the orientation shown in FIG. 7, fluid can flow from the reservoir 118 through the underfill valve 146 and into the transfer chamber 120 to provide make-up fluid that resolves the underfill condition. In an overfill condition (not shown) the valve spool 142 moves toward the diaphragm 133 when engaged by the spool pin 143 due to the additional volume of fluid within the transfer chamber 120 that permits the diaphragm to extend further into the pumping chamber. In an overfill condition, the valve spool 142 covers the opening 164 of the underfill valve 146 while being removed from the opening 156 of the overfill valve 144. This allows fluid to flow from the transfer chamber 120 to the reservoir 118 to resolve the overfill condition.

The pump 100 also includes a friction assembly 180 that helps to maintain an axial position of the valve spool 142 in the transfer chamber 120. Friction assembly 180 includes a ball 182, an adjustor 184, and a spring 186. The adjustor 184 can be adjusted relative to a position of the valve spool 142 and the ball 182 to increase or decrease the bias force exerted by the spring 186 against the ball 182. Varying the bias force applied by the spring 186 alters a friction force applied by the ball 182 against the valve spool 142. A similar friction assembly may not be necessary in the pump of FIGS. 1-6 because the valve spool 42 is retained within recess 52. In other embodiments of pump 10 that do not include such a recess, a friction assembly may be more useful.

FIGS. 1-6 illustrate an asynchronous pump configuration and FIG. 7 illustrates a synchronous pump configuration. The configuration of the valve spools 42, 142 in combination with the overfill and underfill valves 44, 144 and 46, 146 provides for the use of a relatively small diameter piston (valve stem 34, 134) with a relatively flexible elastomeric diaphragm. The use of flexible elastomeric diaphragms and small diameter pistons makes it possible, in many circumstances, to reduce the size and cost of the pump.

The valve spool described with reference to the above examples can maintain a static position so long as there is a correct amount of hydraulic oil in the transfer chamber behind the diaphragm. The valve spool can maintain this static state regardless of the position of the diaphragm during its stroke between fully extended and fully retracted positions. When in a static state, the valve spool covers openings to the check valves positioned between the transfer chamber and the fluid reservoir. Thus, the valves are operated only when an overfill or underfill condition is present such that the valve spool moves to expose an opening to one or the other check valve. The limited operation of the relief valves provides some advantages over pressure-based systems in which the relief valve is actuated at the top or bottom of most piston strokes. The more a valve is operated, the more susceptible the valve is to wear.

Another advantage of the example pumps described above relates to the number of components necessary to correct both overfill and underfill conditions in the pump. Pressure-based systems typically require separate components to address overfill conditions versus underfill conditions. The example pumps described herein use a single spool member to correct both overfill and underfill conditions. Further, the example spool valves disclosed herein function in conjunction with a pair of relatively simple check valves that receive little wear and use because they are only activated when an overfill or underfill condition is present.

The above specification, examples and data provide a complete description of the manufacture and use of the composition of the invention. Since many embodiments of the invention containment shell are made without departing from the spirit and scope of the invention, the invention resides in the claims hereinafter appended.

I claim:

1. A diaphragm pump, comprising:

a piston adapted for reciprocal movement between a first position and a second position, the reciprocal movement defining a piston stroke;

a diaphragm movable between first and second positions that correlate with the first and second piston positions;

a pumping chamber on one side of the diaphragm;

a transfer chamber on the other side of the diaphragm defined in part by the first and second positions of the diaphragm and the piston, the transfer chamber being filled with a hydraulic fluid;

first and second valves;

a fluid reservoir in fluid communication with the transfer chamber via the first and second valves;

a valve spool positioned in the transfer chamber and movable in the transfer chamber relative to the diaphragm, the valve spool arranged to cover openings to the first and second valves when the valve spool is in a first position, to cover the opening to the first valve and open the opening to the second valve when the valve spool is in a second position, and to open the opening to the first valve and cover the opening to the second valve when the valve spool is in a third position;

wherein the spool maintains the first position independent of movement of the diaphragm until an overfill condition is generated in the transfer chamber that moves the valve spool to the second position, or until an underfill condition is generated in the transfer chamber that moves the valve spool to the third position.

2. The diaphragm pump of claim 1, further comprising a valve stem and at least one stop member coupled to the valve stem, wherein the at least one stop member is configured and arranged to engage the valve spool when the overfill or underfill condition is generated.

3. The diaphragm pump of claim 1, wherein the first and second valves are configured as check valves that permit fluid flow in a single direction.

4. The diaphragm pump of claim 1, further comprising a valve stem coupled to the diaphragm and positioned at least partially within the transfer chamber, wherein the valve spool is retained by the valve stem.

5. The diaphragm pump of claim 4, wherein the valve stem is coaxial with the piston to provide synchronous movement of the piston and diaphragm.

6. The diaphragm pump of claim 4, wherein the piston and valve stem are biaxial with each other to provide asynchronous movement of the piston and diaphragm.

7. The diaphragm pump of claim 1, further comprising a biasing member adapted and configured to generate a pressure condition in the transfer chamber that is greater than a pressure condition in the pumping chamber.

8. The diaphragm pump of claim 4, wherein the spool includes an inner circumference surface that engages an outer circumference surface of the valve stem, and the valve spool and valve stem are arranged coaxially.

9. A method of balancing fluid pressure in a hydraulically driven diaphragm pump, the pump including a diaphragm, a piston, a transfer chamber interposed between the diaphragm and the piston, a fluid reservoir, a spool member, and at least one valve providing fluid communication between the fluid reservoir and the transfer chamber, the method comprising the steps of:

moving the piston to alter a position of the diaphragm; and controlling with the spool member fluid flow between the fluid reservoir and the transfer chamber through the at least one valve with the spool member, the spool member being movable in the transfer chamber independent of movement of the diaphragm, wherein the spool member maintains a first position restricting fluid flow through the at least one valve independent of movement of the diaphragm until an overfill condition or an underfill condition of fluid in the transfer chamber is generated to cause the spool member to move thereby permitting fluid flow through the at least one valve;

wherein the pump includes first and second valves, the first valve being configured to permit fluid flow from the transfer chamber to the fluid reservoir and the second valve being configured to permit fluid flow from the fluid reservoir to the transfer chamber, the method further comprising moving the spool member to expose an opening to the first valve and cover an opening to the second valve when the overfill pressure condition exists, and moving the spool member to close the opening to the first valve and exposed the opening to the second valve when the underfill pressure condition exists.

10. The method of claim 9, wherein controlling the spool member includes engaging the spool member with a portion of a valve stem, the valve stem coupling the piston to the diaphragm.

* * * * *